US010295287B2

(12) United States Patent
Verney-Carron

(10) Patent No.: US 10,295,287 B2
(45) Date of Patent: May 21, 2019

(54) LINEAR REPEATING FIREARM WITH ASSISTED EJECTION

(71) Applicant: Verney-Carron S.A., St-Etienne (FR)

(72) Inventor: Pierre Verney-Carron, Rivas (FR)

(73) Assignee: Verney-Carron S.A. (FR)

( * ) Notice: Subject to any disclaimer, the term of this patent is extended or adjusted under 35 U.S.C. 154(b) by 0 days.

(21) Appl. No.: 15/304,423

(22) PCT Filed: Apr. 2, 2015

(86) PCT No.: PCT/FR2015/050861
§ 371 (c)(1),
(2) Date: Oct. 14, 2016

(87) PCT Pub. No.: WO2015/158980
PCT Pub. Date: Oct. 22, 2015

(65) Prior Publication Data

US 2017/0045318 A1 Feb. 16, 2017

(30) Foreign Application Priority Data

Apr. 14, 2014 (FR) ..... 14 53312

(51) Int. Cl.

| | |
|---|---|
| ***F41A 1/00*** | (2006.01) |
| ***F41A 3/26*** | (2006.01) |
| ***F41A 5/18*** | (2006.01) |
| ***F41A 17/32*** | (2006.01) |

(52) U.S. Cl.
CPC ..... *F41A 3/26* (2013.01); *F41A 5/18* (2013.01); *F41A 17/32* (2013.01)

(58) Field of Classification Search
USPC ..... 89/9, 199, 132, 152, 153
See application file for complete search history.

(56) References Cited

U.S. PATENT DOCUMENTS 1,360,873 A 11/1920 Björgum
4,579,034 A * 4/1986 Holloway ..... F41A 3/26 42/18

FOREIGN PATENT DOCUMENTS

CH 40069 A 6/1908
DE 105618 C 10/1899

* cited by examiner

*Primary Examiner* — J. Woodrow Eldred
(74) *Attorney, Agent, or Firm* — Forge IP, PLLC

(57) ABSTRACT

A linear repeating firearm, with assisted ejection, including: a mechanism capable of recovering the energy resulting from pressure exerted when firing a round of ammunition by a gas operated system, to move a mobile assembly against return spring and including a stopper, a latch and a striker cooperating with a hammer controlled by a trigger. A locking mechanism is provided at the rear of the mobile assembly, to lock the mobile assembly in the compressed position of the return spring, after each shot. A manually actuatable unlocking assembly is capable of acting on the locking mechanism to release the mobile assembly and allow the assisted return of the assembly for reloading.

6 Claims, 1 Drawing Sheet

LINEAR REPEATING FIREARM WITH ASSISTED EJECTION

FIELD OF THE INVENTION

The invention relates to the technical field of firearms.

The invention relates more particularly to a manual repeating firearm of any caliber, particularly of the linear arming type.

BACKGROUND OF THE INVENTION

In a perfectly known manner for a skilled person, this type of weapon includes a movable assembly mounted in a breech casing that comprises the weapon. This movable assembly comprises, essentially, a stopper, a latch and a striker, which can be struck by the tilting effect of a hammer controlled by a trigger, against a return spring. The rearmament and the ejection are thus performed according to a reciprocating movement of the movable assembly which cooperates with an actuating member positioned for example at the front of the weapon, being mounted to slide freely within the barrel, or with an actuating member positioned on the movable assembly.

Arming the percussion system is thus effected in a manual manner, which is not the case for a firearm of the semi-automatic type in which the displacement of the moving assembly is carried out by recovery of the energy resulting from the ammunition fired.

Generally, in the case of a manual repeating firearm, the magazine is removable or is constituted by a stationary magazine and is not actually limited in capacity, being able to receive for example up to 10 cartridges. This is not the case with a semi-automatic firearm in which the magazine is tilting and non-movable and whose capacity is generally limited to a maximum of two cartridges depending on the laws.

SUMMARY OF THE INVENTION

From this state of the art, the problem to be solved by the invention is, in the case of a manual repeating firearm, to assist the various operations, including extraction of the ammunition, the arming of percussion system and the arming of the return system with the objective to assist them in the manner of a semi-automatic weapon by recovering the energy of the ammunition fired. This recovery may be effected in a known manner, by means of an inertial system, through a gas operated system or by the recoil of the gun barrel.

To solve such a problem, a manual repeating firearm has been designed and developed, of the linear type with an assisted ejection of the type comprising means capable of recovering the energy resulting from the pressure exerted when firing a round of ammunition, by a gas operated system, to move a movable assembly against a return spring and comprising a stopper, a latch and a striker cooperating with a hammer controlled by a trigger.

Owing the problem to be solved, this firearm includes:

Locking means of the movable assembly in the compressed position of the return spring to the rear position of its movement, after each shot, A manually actuable unlocking assembly capable of acting on the locking means to release the movable assembly and allow the assisted return of said movable assembly for reloading.

It follows therefore from these characteristics, owing the locking conditions of the movable assembly, that the user must, after each shot, manually intervene before performing the ammunition reloading with the assisted return. This required manual intervention thus allows the weapon to remain in the category of so-called repeating weapons and not in the category of weapons of the semi-automatic type.

Another problem to be solved by the invention is to avoid a shunting of the rear locking of the movable assembly. For this purpose, the unlocking assembly cooperates when actuated with a part capable of neutralizing the weapon percussion system by disengaging the trigger.

In one embodiment, the unlocking assembly is constituted by an articulated rod having an actuating member accessible from outside the weapon.

The link is pivotally mounted with respect to a hinge pin and has an actuating finger cooperating with an opening to be accessible from outside the weapon.

Owing these characteristics, the firearm remains in the category of repeating type weapons, the latter having a magazine of the removable type or a fixed magazine able to receive up to around ten cartridges.

In another embodiment, the locking means at the rear of the movable assembly are constituted by a pivoting fork in communication with the movable assembly.

BRIEF DESCRIPTION OF THE DRAWINGS

The invention is described hereinafter more in detail with the figures of he appended drawings in which.

DETAILED DESCRIPTION OF THE INVENTION

Figures 1, 2, 3, 4, 5:
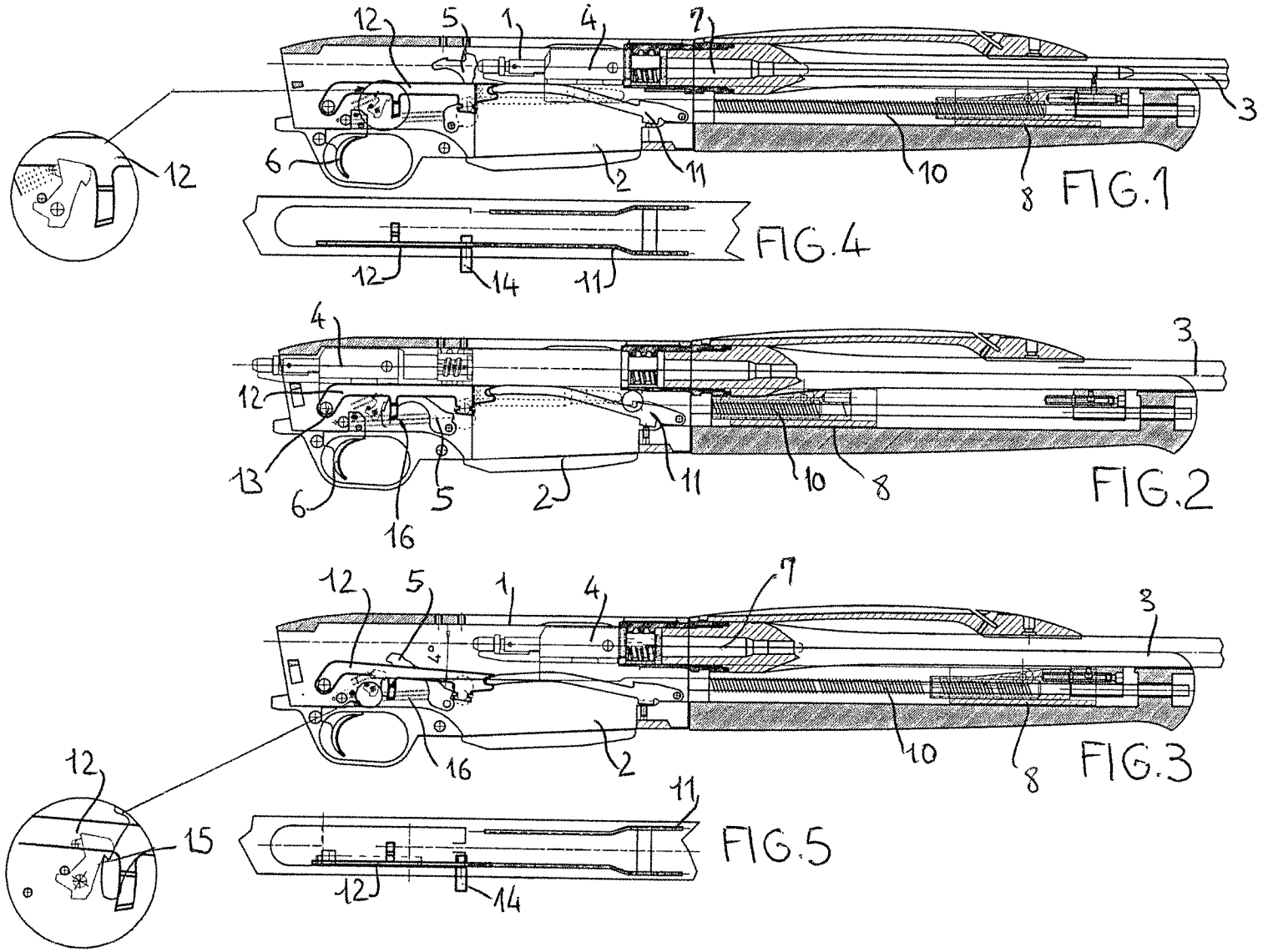
FIG. 1 is a partial view in longitudinal section of an example of a firearm according to the characteristics of the invention shown in phase 1 consisting of firing.
FIG. 2 is a view corresponding to FIG. 1 shown in phase 2 consisting of rear locking of the movable assembly.
FIG. 3 is a view corresponding FIG. 1 shown in phase 3 consisting of the ammunition reloading and the manual unlocking of the movable assembly, and the assisted return.
FIGS. 4 and 5 are partial longitudinal sectional views, taken at the breech casing and corresponding to each of FIGS. 1 and 3.

As stated, the invention applies to any firearm type of the repeating weapon type, whatever the caliber.

This type of weapon is well known for a skilled person and may have various embodiments. Essentially, this type of weapon includes a butt, not shown, a breech casing (1), a magazine (2) and a barrel (3). The breech casing (1) is a movable assembly (4) consisting essentially of a stopper, a latch and a striker, which is struck by the tilting effect of a hammer (5) controlled by a trigger (6).

According to the invention, the arming of the movable assembly (4) is effected by means capable of recovering the energy resulting from the pressure exerted during the firing of an ammunition (7). This energy is recovered by a gas operated system. This energy recovery allows therefore the displacement of the movable assembly (4) against a resilient return member (10). Finally, the weapon also comprises rear locking means of the movable assembly (4) in the compressed position of the return spring (10). These locking means are constituted by a pivoting fork (11) in communication with the movable assembly.

According to an important characteristic of the invention, the weapon has a manually actuatable unlocking assembly capable of acting on the fork (11) to release the movable assembly (4) and allow the assisted return of the movable assembly (4) with a view to reloading. As shown in the drawing figures, the unlocking assembly is constituted by a articulated rod (12). More particularly, the link (12) is pivotally mounted with respect to a hinge pin (13) and has an actuating finger (14) cooperating with an opening to be accessible from outside the weapon. The user is therefore obliged to intervene manually on the link (12) after each shot to allow the unlocking of the movable assembly (4) to perform the ammunition reloading, with an assisted return.

To prevent a shunting of the rear unlocking of the movable assembly (4) by exerting, for example, a continuous pressure on the link (12), this link (12) cooperates, when actuated manually, with a part (15) adapted to neutralize the weapon percussion system by disengaging the trigger.

Reference is made to the drawing figures which show the operating principle of the weapon according to the invention.

In FIG. 1, which corresponds to the firing of the weapon, the latter is closed, and the hammer (5) strikes the movable assembly (strikes the striker) (4) for the departure of the ammunition (7).

Under the effect of the pressure exerted by the departure of the ammunition, the energy is recovered for the displacement of the movable assembly (4).

In FIG. 2, which corresponds to the recovery of energy, there is an assisted ejection of the ammunition (7). The hammer (5) is reset under the effect of reversing the movable assembly (4), and the spring (16) of the dog is compressed. In this locking position, so we have an assisted ejection of the ammunition (7), a loading of the spring (16) of he assisted dog (5) and a loading of the assisted return spring (10).

FIG. 3 shows the reloading phase, after unlocking of the movable assembly (4) following a pressure exerted on the unlocking link (12) which cooperates in abutment with the fork (11). As indicated, unlocking the fork (11) ensures the release of the trigger (6), prohibiting therefore the percussion system. It follows from these provisions that the shunting of the rear unlocking is impossible, given that pressing the link (12) neutralizes the percussion system. Therefore, the manual action on the link (12) before recharging is required at each reloading.

It is apparent from these characteristics that the weapon remains a repeating type weapon, with therefore the possibility to use a large capacity magazine (2), including a fixed or movable magazine, liable therefore to contain around ten cartridges.

The advantages are apparent from the description, in particular, with emphasizing and reminder of the assistance to phases of extraction and ejection of the ammunition, arming of the percussion system and arming of the return system as opposed to a conventional linear arming weapon, so that the weapon according to the invention performs, in some phases, such as a semi-automatic weapon with, importantly, a compulsory and systematic phase consisting of a manual action after firing a round of ammunition, that is to say before the reloading phase.

The invention claimed is:

1. A manual repeating firearm with assisted ejection comprising:

Means capable of recovering energy resulting from pressure exerted when firing an ammunition by a gas operated system to move a movable assembly against a return spring, wherein the firearm comprises:

Locking means for locking the movable assembly in a compressed position of the return spring at a rear position of movement of the movable assembly, after each shot, A manually actuatable unlocking assembly capable of acting on the locking means to release the movable assembly to allow the assisted return of said movable assembly to perform an ammunition reloading in the manner of a semi-automatic firearm.

2. The firearm according to claim 1, wherein the unlocking assembly is constituted by an articulated rod having an actuating member accessible from outside the firearm.

3. The firearm according to claim 2, wherein the articulated rod is pivotally mounted with respect to a hinge pin and has an actuating finger cooperating with an opening to be accessible from outside the firearm.

4. The firearm according to claim 1, wherein the firearm comprises a detachable magazine adapted to receive up to ten cartridges.

5. The firearm according to claim 1, wherein the locking means of the movable assembly is constituted by a pivoting fork in communication with said movable assembly.

6. The firearm according to claim 1, wherein the firearm comprises a fixed magazine adapted to receive up to ten cartridges.

* * * * *